United States Patent [19]

Rausing et al.

[11] Patent Number: 4,814,043

[45] Date of Patent: Mar. 21, 1989

[54] APPARATUS FOR THE MANUFACTURE OF A MATERIAL IN THE FORM OF SHEETS OR A WEB PROVIDED WITH A WATERMARKLIKE PATTERN

[75] Inventors: Hans Rausing, Wadhurst, England; Ingvar Nilsson, Åkarp, Sweden

[73] Assignee: Svecia Antiqua SA, Fribourg, Switzerland

[21] Appl. No.: 102,837

[22] Filed: Sep. 30, 1987

Related U.S. Application Data

[62] Division of Ser. No. 821,341, Jan. 22, 1986, Pat. No. 4,720,325.

[30] Foreign Application Priority Data

Jan. 24, 1985 [GB] United Kingdom ..... 8501756
Aug. 29, 1985 [GB] United Kingdom ..... 8521504

[51] Int. Cl.[4] ..... D21H 5/06

[52] U.S. Cl. ..... 162/286; 51/22; 51/74 R; 162/362

[58] Field of Search ..... 162/286, 362; 51/22, 51/74 R; 493/287, 370

[56] References Cited

U.S. PATENT DOCUMENTS 4,645,484 2/1987 Niske ..... 51/74 R
4,711,797 12/1987 Niske .
4,746,058 5/1988 Niske .

*Primary Examiner*—Peter Chin
*Attorney, Agent, or Firm*—Burns, Doane, Swecker & Mathis

[57] ABSTRACT

A material (1) in the form of sheets or a web is provided with a watermarklike pattern (12) in form of a text, figure or similar identification mark visible or displayable in transmitted light by means of relieflike mechanical working off of material, for example grinding, milling etc., corresponding to the desired pattern (12).

5 Claims, 1 Drawing Sheet

APPARATUS FOR THE MANUFACTURE OF A MATERIAL IN THE FORM OF SHEETS OR A WEB PROVIDED WITH A WATERMARKLIKE PATTERN

CROSS-REFERENCE TO RELATED APPLICATION

This application is a division of U.S. patent application Ser. No. 821,341, filed Jan. 22, 1986 now U.S. Pat. No. 4,720,325.

FIELD OF THE INVENTION

The present invention relates to a method for the manufacture of a material in the form of sheets or a web, in particular writing or document paper such as securities of the type of cheques, bank-notes etc., provided with marks detectable or made visible in transmitted light or radiation. The invention also relates to material in the form of sheets or a web manufactured in accordance with the method.

BACKGROUND OF THE INVENTION

The providing of writing and document paper with so-called watermarks has been known for a long time. Such watermarks in principle are invisible but appear clearly when the sheet of paper is held up against light or light is transmitted through it in some other manner. Traditionally watermarks are produced by impressions in, or contact with, strongly hydrated paper pulp distributed on the screen of a paper machine. The operation is carried out with the help of a so-called dandy roll.

Such watermarks are expensive to produce if the watermarked material is not to be manufactured in large quantities. As a rule, it is not economically justifiable to provide private note-paper with special using this prior practice.

However, there is a possibility of producing so-called false watermarks (marks of watermark character detectable or made visible in transmitted light or radiation) in a chemical manner. These "watermarks" are produced in that the optical refractive index of the paper is altered locally by applying a chemical substance, for example a polymerizable substance, to the paper in the desired pattern. However, it has been found that these false watermarks are often quite visible without any transmittance of light and that they give the impression of a "grease mark" having been made on the paper.

The abovementioned methods are subject to disadvantages which can be avoided with the help of the present invention which is characterized in that desirable watermarklike markings are produced by differentiated working off of material from a web to provide a graded reduction of thickness forming a text or a picture.

BRIEF DESCRIPTION OF THE DRAWING

The invention will be described in the following with reference to the attached schematic drawing wherein.

DETAILED DESCRIPTION OF THE PREFERRED EMBODIMENT

A watermark of the type not directly visible has been used for a long time as a proof of legitimacy of documents and securities such as bank-notes, share-certificates, etc. Marking of this type has also been used to identify the manufacturer of a paper, on business note-paper and to a certain limited extent for private note-paper, mainly hand-made paper. The reason why the marking of machine-manufactured private note-paper with watermarks is not economically justifiable is that with the prior methods it is not worthwhile to manufacture less than approximately ten tons of paper with a marking.

The method in accordance with the present invention makes it possible to produce in an economic manner private note-paper, business paper and document paper in substantially small quantities than if traditional watermarking were to be used. It is a further advantage that the marking can be placed on the individual paper sheets with considerably greater precision and that the contours of the marking will be more distinct.

Figure 1:
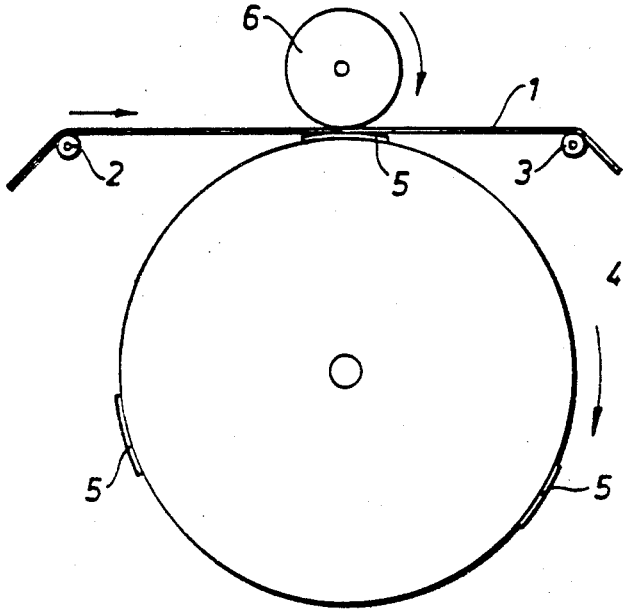
FIG. 1 is a side view of an apparatus for providing a paper web with a watermarklike pattern in accordance with a preferred method of the present invention and FIG. 2 is an enlargement of the area surrounded by broken lines in FIG. 1.

Referring to FIG. 1, a paper web 1 is provided with watermarklike pattern. The paper web is fed over deflection rollers 2 and 3 and a matrix roll 4. The matrix roll 4 has local projections (matrices) 5 which rest against the regions of the web which are to be provided with the said pattern. As indicated in FIG. 1 the matrix roll 4 rotates in the direction of the paper web at the same speed as the latter so that slipping between the roll 4 and the web 1 is avoided. Adjoining the roll 4 a grinding roller 6 is arranged at such an adjustable distance from the roll 4 that parts of the paper web 1 which rest against the surface of the roll can narrowly pass the gap between the grinding roller 6 and the roll 4. This obviously means that no grinding occurs on these parts of the web 1. FIG. 1 further shows that the grinding roller 6 is smaller than the roll 4 and that it is adapted to rotate in the direction toward the roll 4. The grinding roller 6 is rotated at a speed which is higher, preferably substantially higher, than the speed of rotation of the roll 4.

Figure 2:
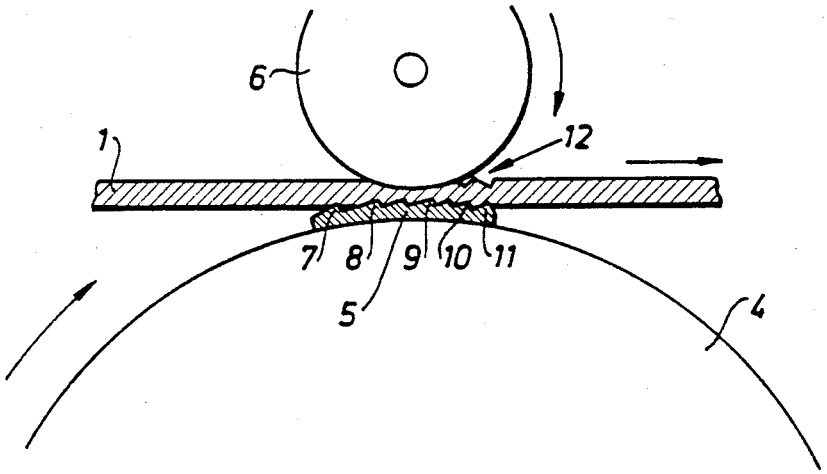

FIG. 2 illustrates in greater detail how the local projections 5 on the material roll 4 can be constituted of mutually adjoining or interconnecting portions 7–11 with points located at different heights above the surface of the roll 4 thus forming a relieflike surface structure which corresponds to the desired pattern. When the matrix roll 4 passes a projection 5 passes along the grinding roll 6, a part of the paper web 1 will be raised toward the grinding roll 6 and, the part so raised is ground away in a graded manner. Thus in the web 1 a "grinding image" (partly appearing at 12) is obtained which in shape, height and position substantially corresponds to the projections 5. On inspecting this grinding image in transmitted light, a watermarklike pattern of mutually adjoining or interconnecting portions of varying degree of light transmittance will be visible on the paper web 1.

The local projections 5 can be produced, for example, from any suitable lasting material such as steel.

It is to be understood that the present invention may be embodied in other specific forms without departing from the spirit or essential characteristics of the present invention. The preferred embodiment is therefore to be considered illustrative and not restrictive. The scope of the invention is indicated by the appended claims rather than by the foregoing descriptions and all changes or variations which fall within the meaning and range of the claims are therefore intended to be embraced therein.

What is claimed is:

1. An apparatus for forming a watermarklike pattern on a web, said apparatus comprising:

a grinding wheel;

a matrix element having a relief conforming with the watermarklike pattern; and means for urging the grinding wheel and the relief of the matrix element in opposing relationship against opposite sides of the web, whereby material from regions of the web contacted by the relief is grinded away to produce the watermarklike pattern.

2. The apparatus according to claim 1, wherein said urging means includes a roll.

3. The apparatus according to claim 1, wherein said urging means includes a roll mounted for rotation about an axis parallel to the axis of rotation of said grinding wheel, said matrix element being mounted on said roll.

4. The apparatus according to claim 3, wherein said apparatus includes guide means for passing a web between said grinding wheel and said roll.

5. The apparatus according to claim 3, wherein the smallest distance between the surface of said grinding wheel and said roll is at least equal to the thickness of said web, and the smallest distance between the highest point of said matrix surface is greater than zero, so that grinding holes through the web are avoided.

* * * * *